MACHINE FOR MANUFACTURING SQUARE BAGS OF THERMOPLASTIC FILM

BACKGROUND OF THE INVENTION

The present invention relates to a square bag made of thermoplastic film and a machine for manufacturing said bag.

In the case of general square bags having a tubular body which is made of thermoplastic film such as polyethylene film and is flat when empty, said tubular body is commonly prepared by the inflation method and is inferior in ink-adsorbing property as it is so that it is impossible to perform a satisfactory printing thereon. Therefore, in order to improve said ink-adsorbing property of such bags, it is usual to apply corona discharge of a high-voltage electricity to the outer surface thereof.

Besides, such bags as above are ordinarily prepared by welding closures made of thermoplastic film onto the outer surface of both the top and bottom openings of said tubular body by heat-sealing.

However, the outer surface of said film subjected to treatment with corona discharge as above loses the affinity with oil inherent in polyethylene and becomes hydrophilic. Accordingly, when two outer surfaces subjected to such treatment alike are heat-sealed with each other, the intercrossing of polyethylene molecules of the welded portions is impeded and said two surfaces are apt to come off simply by the sealed portion when subjected to tension after cooling. Futher, even when a surface subjected to treatment with corona discharge and a surface not subjected to treatment with corona discharge are heat-sealed each other, the welding strength is very weak, entailing a defect that the product bag is apt to open while in use.

With a view to elimination of such defects, it has so far been proposed to scrape off the thus treated surface by a portion required for welding by the use of an edged tool, a file or a wire brush. But, this measure is defective in that, it is very difficult to scrap exclusively the treated portion off the surface without causing damages of the film as a whole, and it fails to produce a satisfactory bag.

Further, it has been proposed to use an adhesive having high adhesive power such as the rubber-type adhesive instead of resorting to heat-sealing in order to avoid the foregoing drawbacks. However, this mreasure is also defective in that it requires preparation of a special adhesive therefor, which means an additional cost of the product bag, as well as a special apparatus for the purpose of drying the adhesive used, which means requirement for an additional time of processing.

SUMMARY OF THE INVENTION

The principal object of the present invention is to provide a square bag which can eliminate the aforementioned drawbacks of the conventional square bags made of thermoplastic film and is free from easy exfoliation of the closures welded by heatsealing onto the top and bottom openings of the tubular body thereof.

Another object of the present invention is to provide a square bag, wherein the top and bottom openings of a tubular body made of thermoplastic film are respectively formed, by pressing vertically, into the front and rear horizontal flaps spreading horizontally and a pair of bisymmetric triangular end plates lapping over both sides of said flaps as folded double, the top and bottom closures made of thermoplastic film cover said front and rear horizontal flaps of the tubular body while two side edges of both closures are inserted beneath the triangular end plates, respectively, lest they should confront the outer surface — which is hard to weld together — of the tubular body, and necessary portions of the inner surface of the tubular body not subjected to treatment with corona discharge and both closures are heat-sealed, whereby the thus heat-sealed portion of the bag is free from easy exfoliation while in use.

A further object of the present invention is to provide a square bag, wherein the top closure consists of a valve plate and a cover plate, one side edge of said cover plate extends over one side edge of said valve plate and forms a valve lip, both the valve plate and cover plate except for the portion constituting said valve lip are heat-sealed onto the top opening of the body so that the valve lip serves as the inlet at the time of receiving articles in the bag while it functions as a nonreturn valve preventing articles from easily escaping therefrom as it closes by virtue of the pressure of articles whenever the bag is filled up with articles, and further the surroundings of the valve lips are firmly welded by heat-sealing so that there is no fear of this portion inducing breakage of the bag.

A still further object of the present invention is to provide a machine for manufacturing a square bag, wherein the work of closing the openings of said tubular body by means of said closures is performed by automatically welding them onto the inner surface of the tubular body which permits easy welding through heat-sealing process, not by the use of any adhesive or by welding said closures onto the outer surface of the tubular body which is hard to weld.

Still another object of the present invention is to provide a machine for manufacturing a square bag, wherein one opening of the tubular body is to be closed by means of a closure consisting of a valve plate and a cover plate through the process comprising welding said valve plate onto the inner surface of the tubular body by heat-sealing, lapping one end of the cover plate over one end of the valve plate and welding the other end of the cover plate onto the inner surface of the tubular plate, whereby a valve lip having the function of nonreturn valve is automatically formed in a corner of the top of bag.

An additional object of the present invention is to provide a machine for manufacturing a square bag, wherein an apparatus for conveying the tubular bag body capable of reciprocating motion with regular stroke is installed beneath a pair of surface plates provided with a slit therebetween, the tubular bag body being conveyed along the slit by means of a clamp mechanism provided for said conveying apparatus is to be received by a clamp mechanism provided for the surface plates and stopped in succession at advanced positions at intervals corresponding to said stroke, and at the time when the tubular bag body thus stops, such operations as the heat-sealing of the closures and so forth are to be carried out.

(VII)

(VIII)

Figure 1:
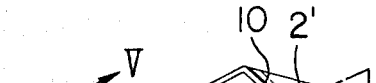
FIG. 1 is a perspective view of a square bag according to the present invention.
Figure 2:
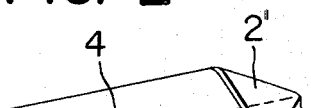
Figure 6:
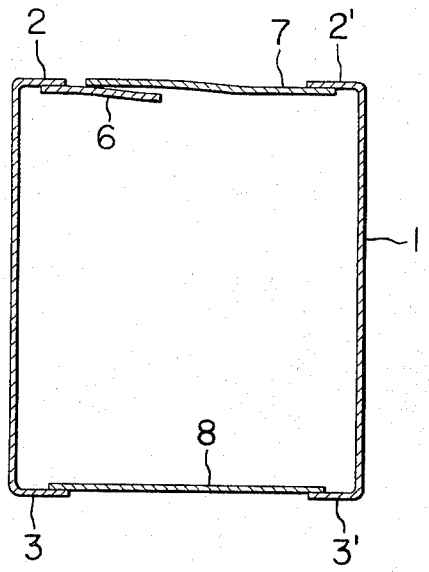
Figure 8:
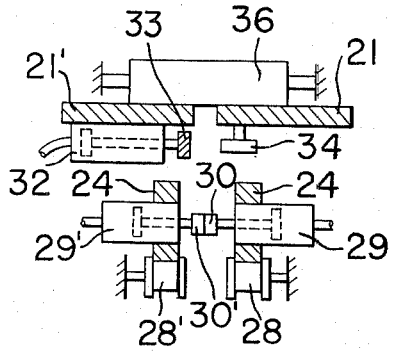

ments 32, 33 and 34 is provided for the surface plates 21 and 21' in all working positions thereafter.

Next, on the top face of the surface plates 21 and 21' located in the working position (III) corresponding to the advanced position of the second set of cylinders 29 and 29', that is, the retreated position of the third set of cylinders 29 and 29', there is provided the press roller 36 to come in contact with said top face of surface plates so as to make reciprocating motion along the direction of progress of the bag body 1 by virtue of an actuating mechanism not shown the drawings.

Figure 9:
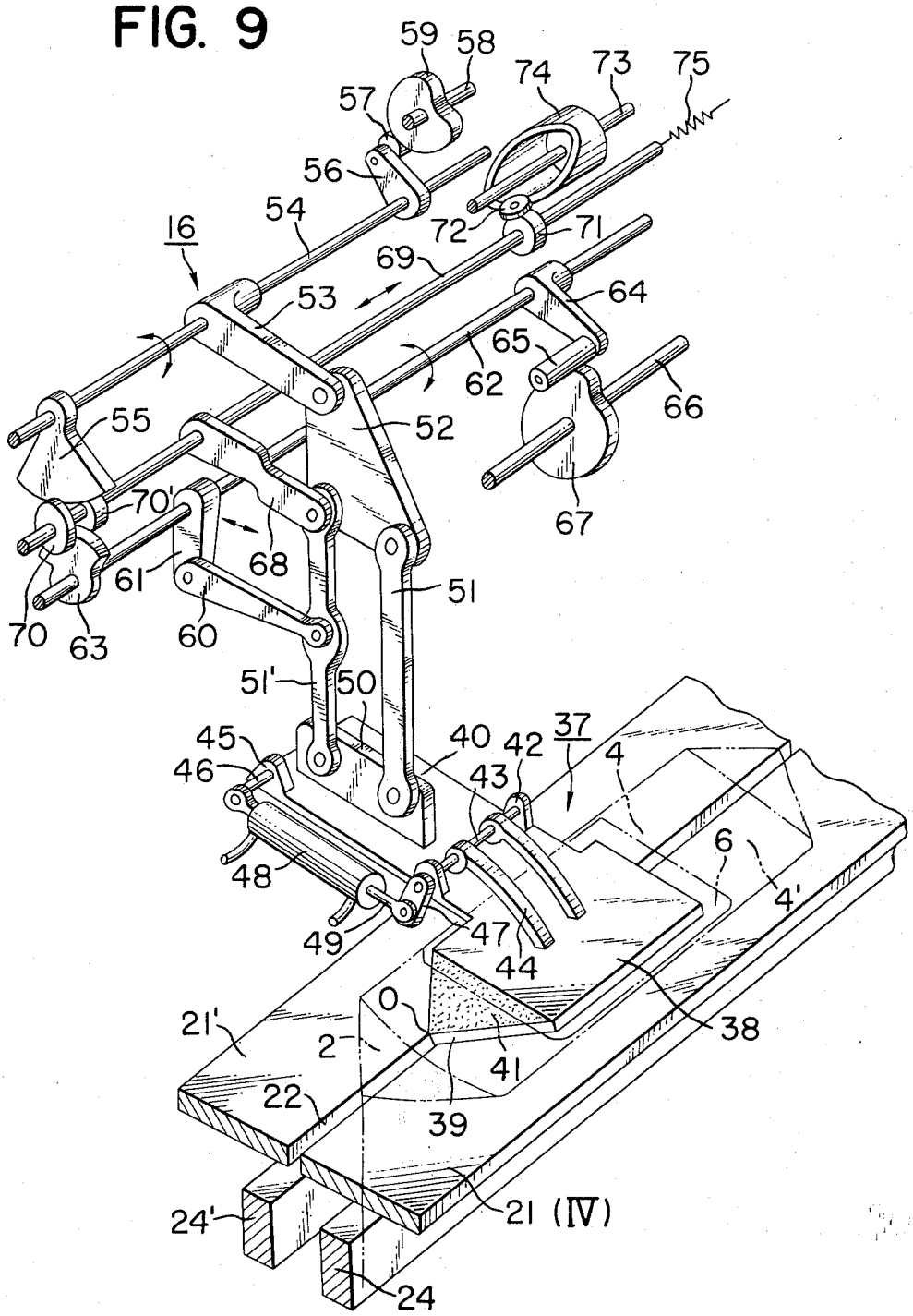

FIG. 9 illustrates the apparatus 16 for installing the valve plate 6.

In the working position (IV) herein, the first receiving plate 37 is disposed to cover the top face of the surface plates 21 and 21', and this receiving plate 37 comprises the rectangular receiving portion 38 having a width almost equal to the total width of the horizontal flaps 4 and 4' of the bag body 1 and a length almost equal to the length of the valve plate 6, the triangular insert portion 39 to be inserted in the triangular end plate 2 of the bag body 1 and which adjoins to the receiving portion 38 and is disposed in the rear thereof along the direction of progress, and the rectangular supporting portion 40 adjoining to the back of the receiving portion 38. And, the surface of the insert portion 39 is provided with the sheet 41 consisting of a heat insulator as stuck thereon.

The top face of the front part of the supporting portion 40 is equipped with a pair of lugs 42, on which the shaft 43 is rotatably supported. On the shaft 43, there are fixed the bases of a pair of grippers 44, and the tips of said grippers are to be in touch or out of touch with the top face of the receiving portion 38 with the rotation of the shaft 43. One extremity of the shaft 43 is fixed to one end of the arm 47. On the top face of the rear part of one side of the supporting portion 40, there is provided the lug 45, and to the outer end of the shaft 46 projecting from said lug 45, the base of the cylinder 48 is pivotally connected. The top of the piston rod 49 of the cylinder 48 is pivotally connected to the other end of the aforesaid arm 47.

Further, the lower ends of a pair of parallel links 51 and 51' are pivotally connected to the supporting plate 50 projecting from the top surface of the approximate center of the supporting portion 40, the upper ends of said parallel links 51 and 51' are pivotally connected to the lower part of the connecting plate 52, the tip of the arm 53 is pivotally connected to the upper part of said connecting plate 52, and the base of said arm 53 is fixed to the rotatable shaft 54 pivotally supported on the frame. On the shaft 54, there are fixed the bases of the segment 55 and the arm 56 as disposed on the opposite sides of the arm 53, and the cam roller 57 is pivotally connected to the fore end of the arm 56. The cam roller 57 is engaged with the cam 59 fixed on the rotatable shaft 58 which is pivotally supported on the frame, whereby the shaft 54 makes reciprocating rotation as indicated by the arrow in FIG. 9 responsive to the rotation of the cam 59.

The fore end of the connecting rod 60 is pivotally connected to the middle of the other link 51', the base of said connecting rod 60 is pivotally connected to the fore end of the arm 61, and the base of said arm 61 is fixed to the rotatable shaft 62 which is pivotally supported on the frame. On the shaft 62, there are fixed the bases of the segment 63 and the arm 64 disposed on the opposite sides of the arm 61, and the cam roller 65 is pivotally connected to the fore end of the arm 64. The segment 63 is so disposed as to correspond to the segment 55. The cam roller 65 is engaged with the cam 67 fixed on the rotatable shaft 66 which is pivotally supported on the frame, whereby the shaft 62 makes reciprocating rotation as indicated by the arrow in FIG. 9 responsive to the rotation of the cam 67.

The fore end of the arm 68 is connected to the pivot of the upper end of the link 51', and the base of the arm 68 is fixed on the shaft 69 which is pivotally supported on the frame and makes reciprocating motion in axial an direction as indicated by the arrow in FIG. 9. This shaft 69 is disposed between the shaft 54 and shaft 62, and on the shaft 69 there are fixed the collars 70 and 70' corresponding to the segment 55 and segment 63 which are interposed between these collars. Further, the collar 71 is fixed on the shaft 69, and the cam roller 72 is pivotally connected to said collar 71. This cam roller 72 is engaged with the cam 74 which is fixed on the rotatable shaft 73 supported pivotally on the frame so as to effect reciprocating motion of the shaft 69. The shaft 69 is constantly pulled to the right in FIG. 9 by means of the spring 75.

Figure 12:
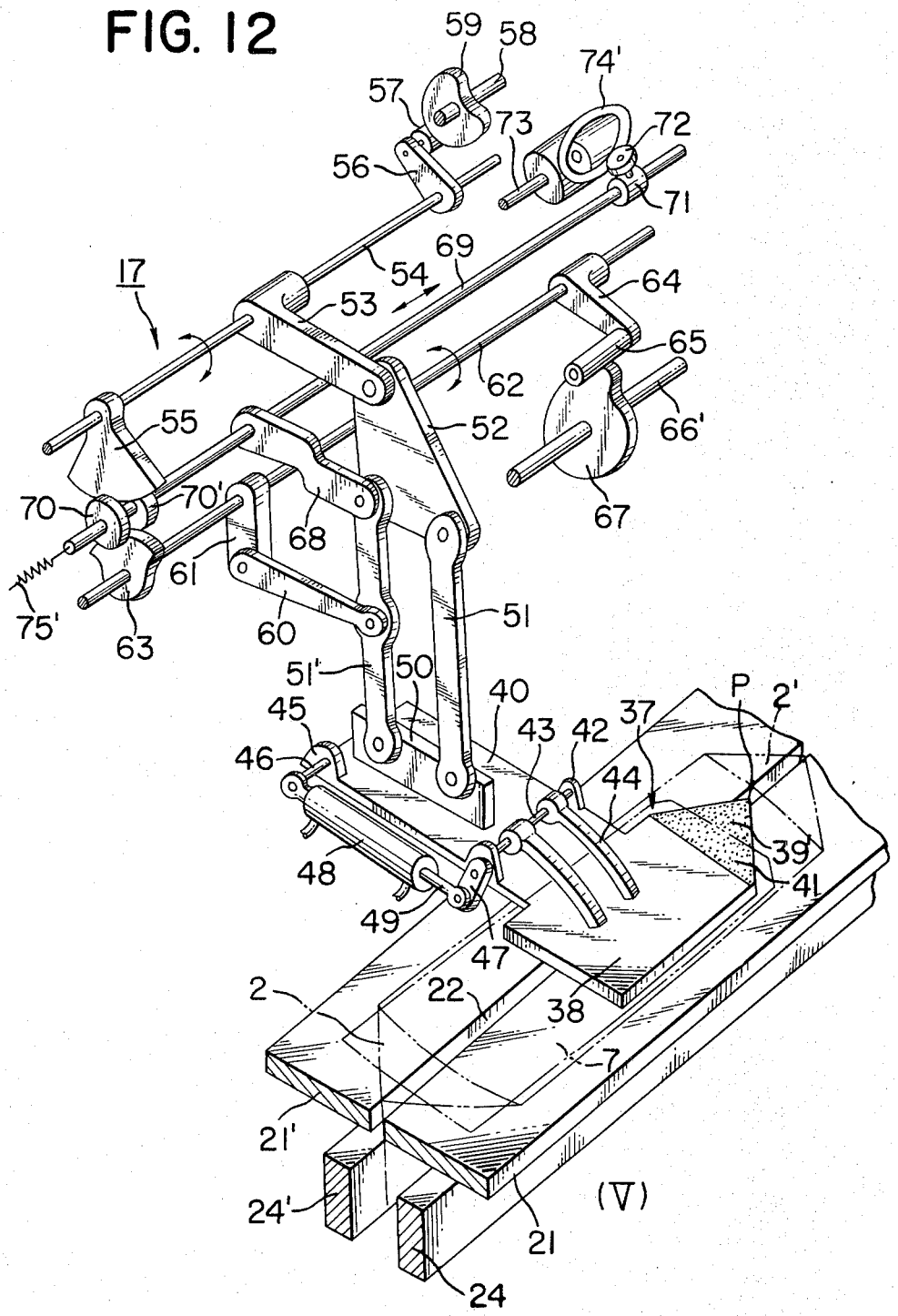

FIG. 12 illustrates the apparatus 19 for installing the top cover plate 7. This apparatus is substantially of the same construction as that of the apparatus shown in FIG. 9, and therefore, in the following explanation thereof, such portions as having identical construction and function will be merely denoted by identical reference numerals to abridge the explanation, and those portions which are different from that of the apparatus of FIG. 9 will be explained and distinguished therefrom by putting a prime (') after the corresponding reference numerals.

In the apparatus shown in FIG. 12, the insert portion 39' of the receiving plate 37' is bisymmetric relative to the aforesaid insert portion 39 so as to be inserted in the triangular end plate 2' of the bag body 1 disposed ahead along the direction of progress. Further, the cam 74' and spring 75' are alo bisymmetrically disposed relative to the aforesaid cam 74 and spring 75.

Figure 15:
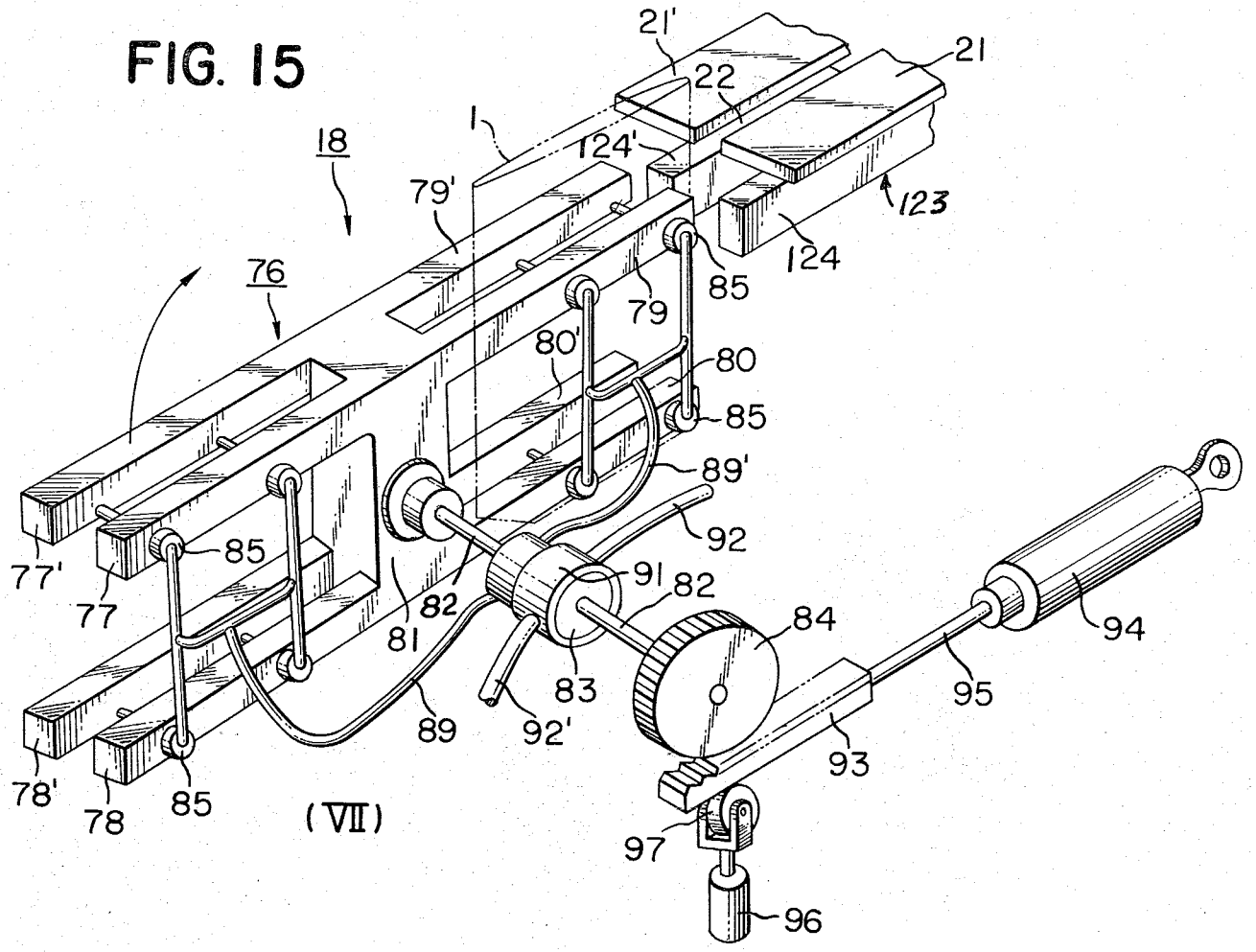
Figure 16:
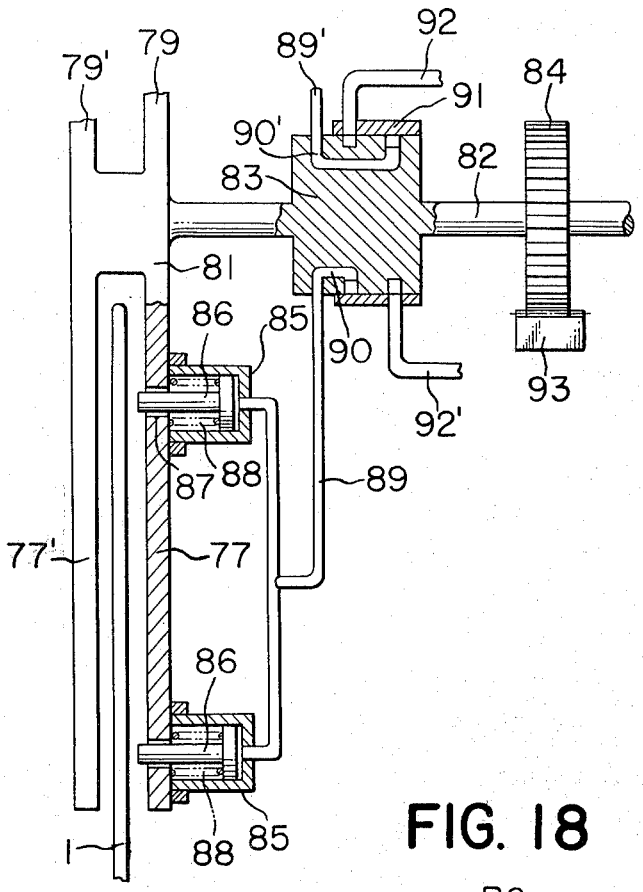

FIGS. 15 and 16 illustrate the apparatus 18 for turning over the bag body 1. This apparatus adjoins to the apparatus shown in FIG. 12 and is disposed in the rear of the bag body 1 along the direction of progress thereof.

In these FIGS. 15 and 16, 76 denotes the rotatable frame, which is provided with four pairs of parallel arms 77, 77', 78, 78', 79, 79' and 80, 80' projecting from the upper and lower ends of the center strut 81 thereof. And, when the rotatable frame 76 is in a horizontal position, the top face of each upper arm practically aligns with the top faces of the surface plates 21 and 21', and the lengthwise space between each pair of arms is to confront the slit 22.

The shaft 82 is fixed to the strut 81, and the enlarged head 83 is provided on the approximate center of said shaft 82. The pinion 84 is fixed to the shaft 82 in front of said enlarged head 83. Further, the shaft 82 is so devised that its vertical position relative to the frame can be adjusted by a mechanism not shown in the drawings. Each of the arms 77, 78, 79 and 80 disposed on the front side of the rotatable frame 76 is provided with a couple of holes 87 respectively, and the cap 85 covers each hole. The piston 86 is inserted in said cap 85, its rod fits in the hole 87, and the piston 86 is constantly biased to be pulled in the cap 86 by means of the spring 88. The air pipes 89 and 89' are respectively connected a halt as indicated by the dotted line. At this, the apparatus for installing the valve plate works to fix the valve plate 6.

Figure 10:
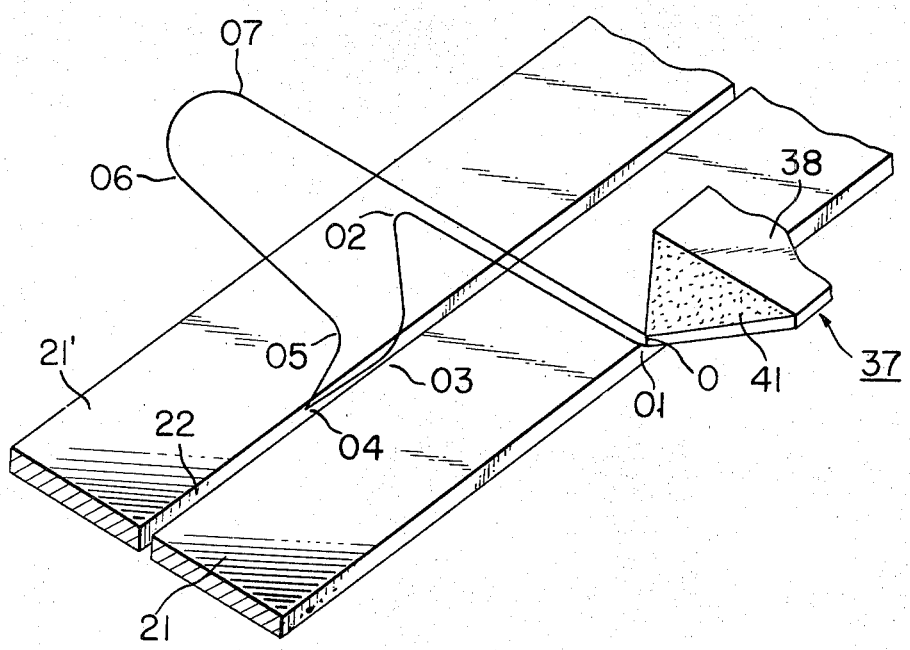
Figure 7:
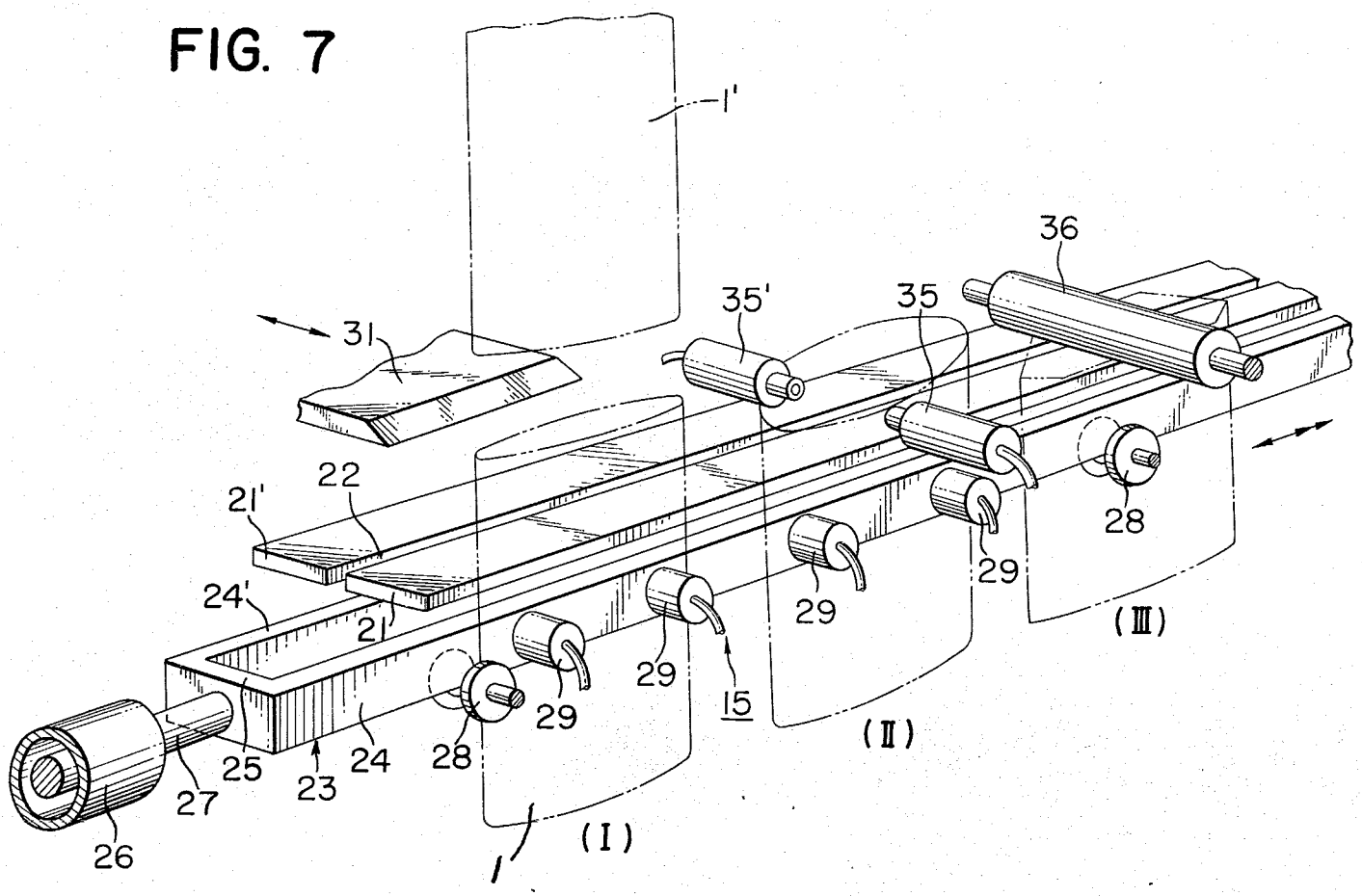

FIG. 10 shows the locus of movement of the fore end O of the insert portion 39 of the receiving plate 37, and the receiving plate 37 stays at an appropriate distance in front of and above the slit 22 as shown in the drawing and the fore end O of the receiving plate 37 is located in the position 01. At this, a practically rectangular valve plate 6 is supplied onto the receiving plate 37 from a supply mechanism not shown in the drawing, and the cylinder 48 works, whereby the valve plate 6 is held on the receiving plate 37 by means of the gripper 44.

Figure 11A:
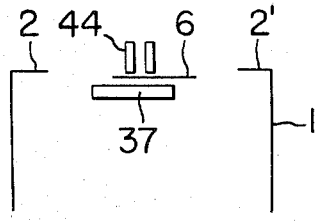
Figure 11B:
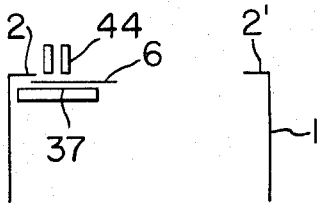
Figure 14B:
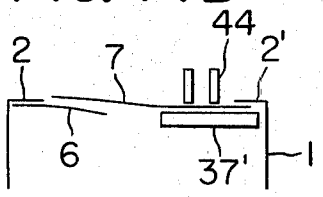

Then, the shaft 62 is rotated clockwise in FIG. 9 by virtue of the rotation of the cam 67, and the link 51', that is, the receiving plate 37 is horizontally moved backward by means of the connecting rod 60 until the fore end O of said plate reaches the position 02 above the slit 22. At this, the shaft 54 is rotated clockwise in FIG. 9 by virtue of the rotation of the cam 59, and the links 51 and 51', that is, the receiving plate 37 is made to descent until the fore end of said plate reaches the position 03 directly above the bag body 1 (cf. FIG. 11A). Then, the shaft 69 is horizontally moved to the left in FIG. 9 by virtue of the rotation of the cam 74, and the fore end O of said plate is moved to the position 04 corresponding to the innermost position of one triangular end plate 2 of the bag body 1, whereby the fore end of the valve plate 6 is inserted beneath the triangular end plate 2 of said body 1 to be overlapped (cf. FIG. 11B).

At this, the portion 9 shown in FIG. 3 is heat-sealed by means of a heat-sealer not shown in the drawing. On this occasion, as the surface of the receiving plate 37 supporting the bottom face of the heat-sealing portion of the valve plate 6 is provided with the heat-insulating sheet 41 sticking thereto, there is no fear of the valve plate 6 being welded on the receiving plate 37. When the heat-sealing is over, the valve plate 6 is released from the holding by the gripper 44.

With the succeeding rotation of the cams 59, 67 and 74, the fore end O of the receiving plate 37 moves inversely and upward along the slit 22 to the position 05, and at this position 05, it turns to a direction almost perpendicular to the former direction to advance to the position 06, ascends thereafter, and returns to the initial position 01 via the position 07.

Then, the bag body 1 reaches the working position (V) shown in FIG. 12 and stops there. At this, the apparatus 17 works to fix the cover plate 7 on the bag body 1.

Figure 13:
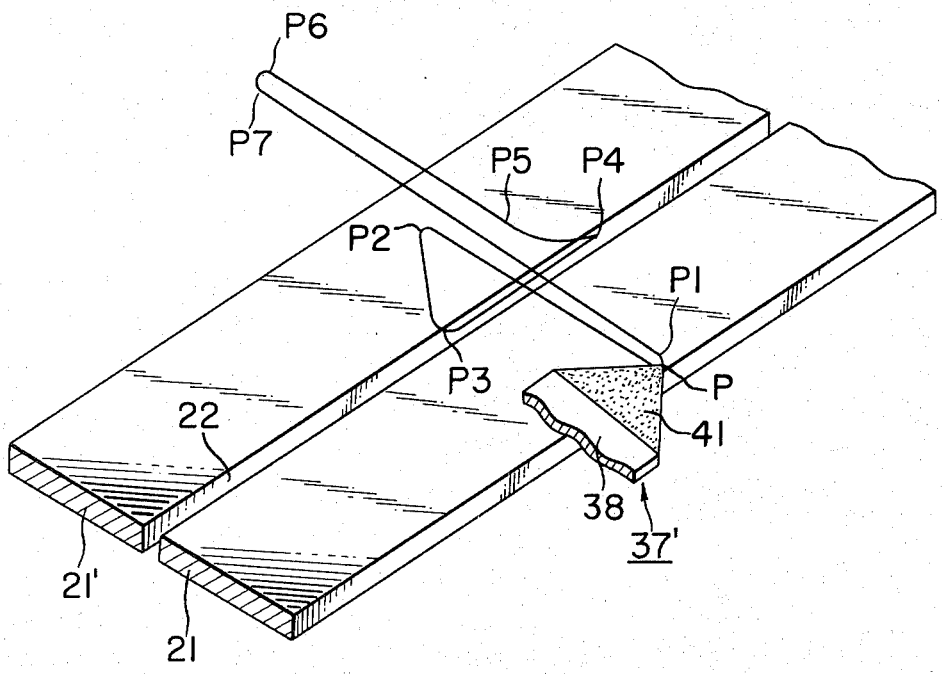

FIG. 13 illustrates the locus of movement of the tip P of the insert portion 39'. In this FIG. 13, the receiving plate 37' stays in the position P1 at an appropriate distance in front of and above the slit 22 as shown by the dotted line therein, and the tip P of said insert portion 39' is located in the position P1, while, on the receiving plate 37', there is supplied the cover plate 7 in the same way as above and same held by the gripper 44.

Figure 14A:
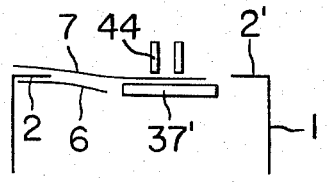

At this, the tip P of the receiving plate 37' moves along the locus shown in FIG. 13 by virtue of the rotation of the cams 67, 59 and 74' in the same way as above, and comes to be in such a state as shown in FIG. 14A at the position P3 to thereby make the phases of the tip of the cover plate 7 and the triangular end plate 2' of the bag body 1 agree, and subsequently, at the position P4, the former plate 7 is inserted beneath the inner surface of the latter plate 2' for overlapping.

Then, in the same way as above, the portion 10 shown in FIG. 4 is heat-sealed, the holding of the cover plate 7 by the gripper 44 is released thereafter, and the tip P returns to its initial position P1 by virtue of the succeeding rotation of the cams 67, 59 and 74' via the position P5, P6 and P7 shown in FIG. 13.

Subsequently, the bag body 1 is conveyed to the working position (VI) not shown in the drawings. At this, a pair of linear heat-seals not shown in the drawings, which extend lengthwise in parallel at a prescribed distance and stand by above said position (VI), are made to descent onto the bag body 1, whereby the front and rear edges 11 and 12 of the valve plate 6 and the cover plate 7 shown in FIG. 1 are heat-sealed onto the top of the bag body 1. This operation can be performed by a conventional means, and therefore, illustration thereof will be omitted herein.

Next, the bag body 1 is conveyed to the working position (VII) shown in FIG. 15, and this position is provided with the apparatus for turning over the bag body.

the carriage 23 (not shown in FIG. 15) holds between the rails 24 and 24' equipped thereon the bag body 1 having the valve plate 6 and the cover plate 7 as heat-sealed on its top. When these rails 24 and 24' come in between the front and rear arms 77, 78 and 77', 78' and stop there, air is blown into the air pipes 89 to thrust out the piston rods 86 within the caps 85 to the inside of the arms 77 and 78, and the bag body 1 is pressed against the confronting arms 77' and 78' and held stationarily. Then, the bag body 1 is released from the clamping by the rails 24 and 24', the carriage 23 retreats, the cylinder 94 works to rotate the pinion 84 clockwise in FIG. 15, the rotatable frame 76 turns by 180° and stops when the bag body 1 became upside-down at the position indicated by the dotted line in FIG. 15.

Subsequently, the rails 124 and 124' of the carriage 123 located at the rear of the apparatus 18 shown in FIG. 15 go in between the arms 77, 78 and 77', 78' of the opposite side moved in the position of the arms 79, 80 and 79', 80' and clamp the bag body 1. At this, with the discharge of air from the caps 85 through the air pipe 89, the piston rod 86 is withdrawn, and the bag body 1 is released from the clamping.

Figure 17:
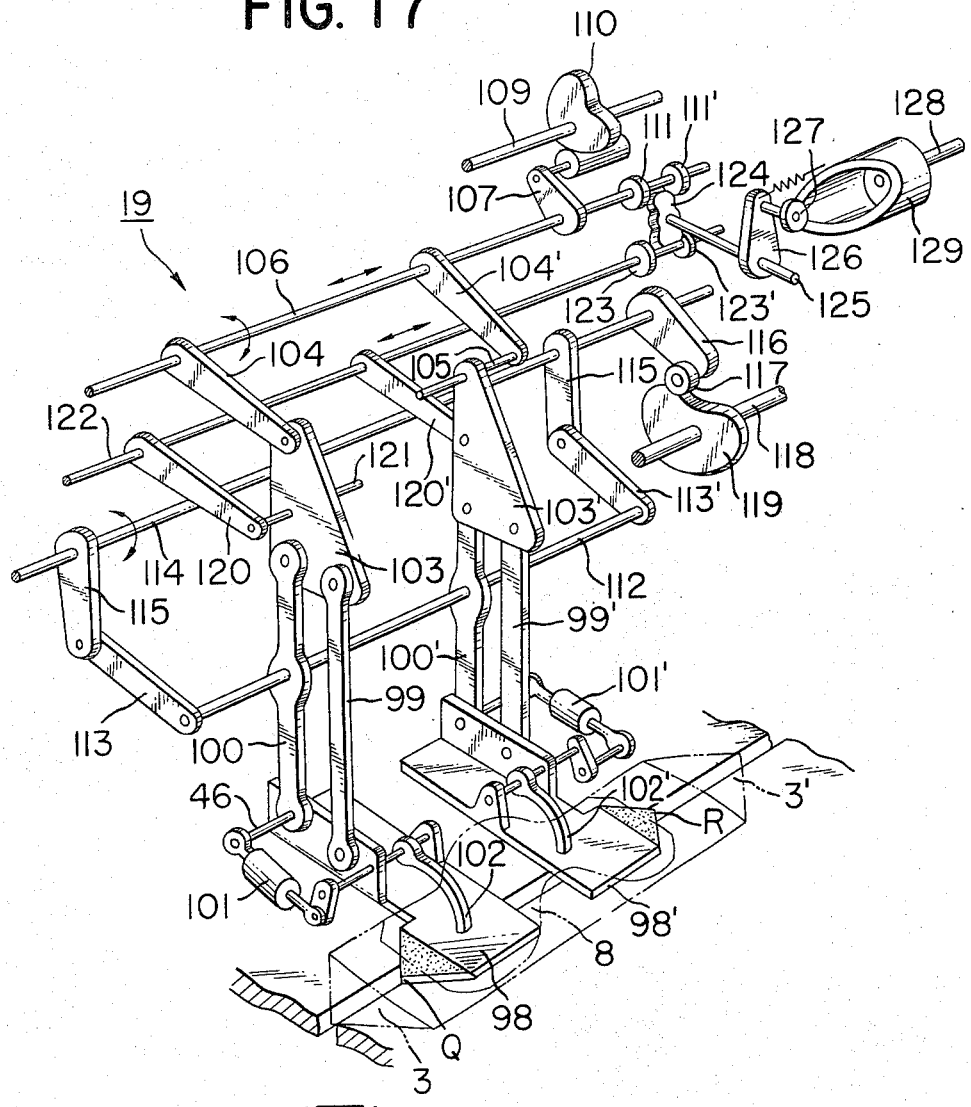
Figure 16:
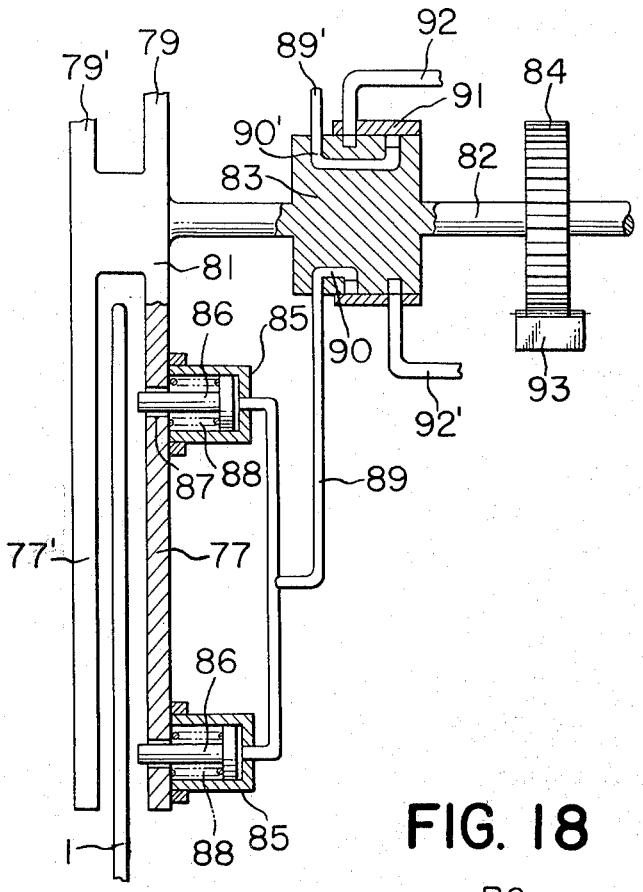
Figure 19A:
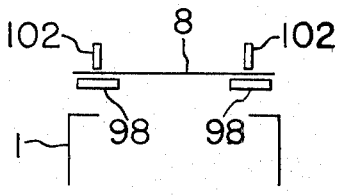
Figure 19B:
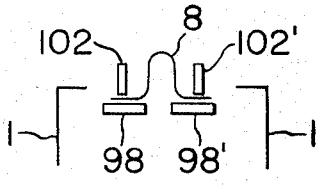
Figure 19C:
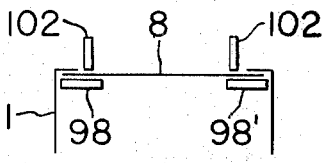
Figure 18:
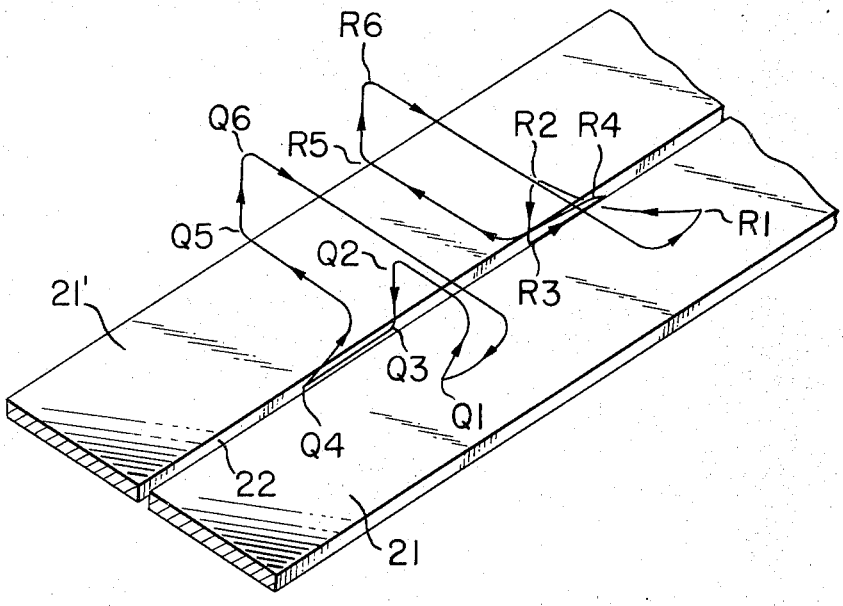

Next, the bag body 1 is conveyed to the working position (VIII) shown in FIG. 17 by the rear carriage 23 and stops there. At this, the apparatus 19 works to fix the cover plate 8 on the bag body 1.

Figure 19A:
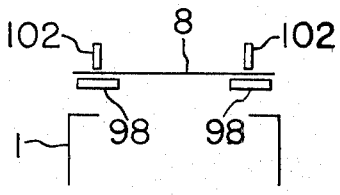
Figure 18:
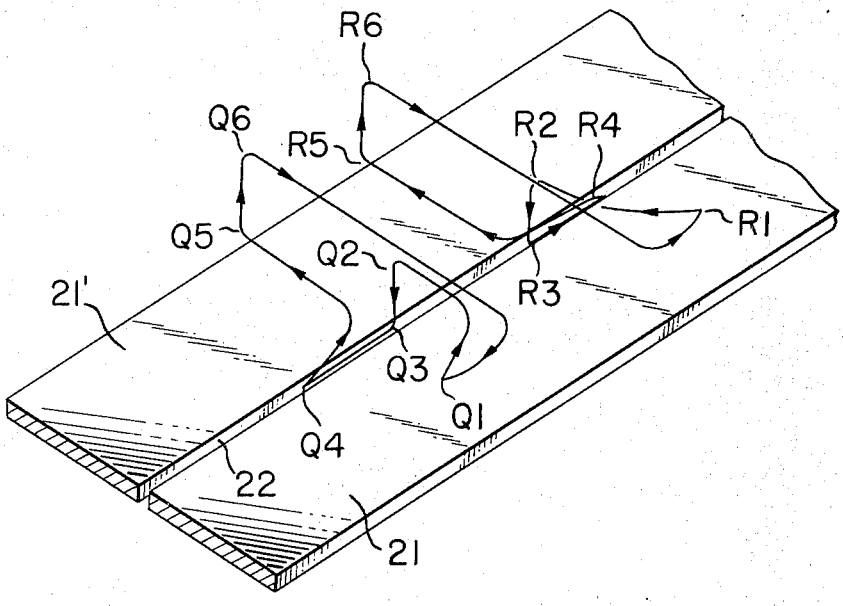

FIG. 18 shows the loci of movement of the tips Q and R of the receiving plates 98 and 98', and both receiving plates herein stay with their tips Q and R located in positions Q1 and R1 at appropriate distances in front of and above the slit 22. At this, one rectangular cover plate 8 is supplied in the same way as above onto both receiving plates 98 and 98', and two edges of said cover plate 8 are held by the grippers 102 and 102' (cf. FIG. 19A).

Then, the shift plate 124 turns clockwise in FIG. 17 with the rotation of the cam 129, the shaft 106 moves to the right while the shaft 122 moves to the left in FIG. 17 simultaneously by means of the collars 111, 111' and 123, 123' holding this plate 124, and with this movement the connecting plates 103 and 103' and the receiving plates 98 and 98' come close to each other through the links 99, 100 and 99', 100', and two edges of the plate 8 are drawn near to each other and its center swells to be mountain-shaped as shown in the same drawing. At this, by the rotation of the cam 119, the shaft 114 is rotated clockwise in the same drawing, and the links 100 and 100', that is, the tips Q and R of the receiving plates 98 and 98' are moved back until they reach the positions Q2 and R2 above the slit 22 by means of the connecting rods 113 and 113'.

Figure 19B:
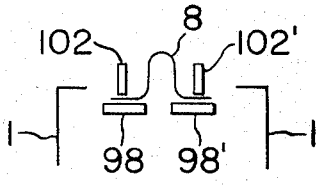

Then, the shaft 106 is rotated clockwise in the same drawing by the rotation of the cam 110, and the receiving plates 98 and 98' are moved by means of the connecting plates 103 and 103' and the links 99, 100 and 99', 100', whereby the tips Q and R of these receiving plates reach the positions Q3 and R3 directly above the bag body 1 (cf. FIG. 19B).

Figure 19C:
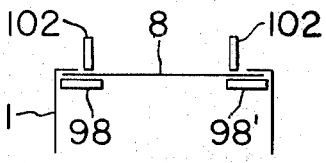

At this, by the rotation of the cam 129, the shift plate 124 is rotated anticlockwise, the shaft 106 is moved to the left while the shaft 122 is moved to the right simultaneously, the receiving plates 98 and 98' are held aloof from each other, and the tips Q and R are shifted to the positions Q4 and R4 corresponding to the innermost portion of the triangular end plates 3 and 3' of the bag body 1, whereby the two edges of the cover plate 8 are respectively inserted beneath the triangular end plates 3 and 3' for overlapping (cf. FIG. 19C).

Then, in the same way as in the case of the aforesaid top portion of the bag body 1, the cover plate 8 and both triangular end plates 3 and 3' are heat-sealed along the direction perpendicular to the direction of progress of them, the cover plate 8 is released from the holding by the grippers 102 and 102' after heat-sealing, and the receiving plates 98 and 98' are moved so as to make their tips Q and R return to their initial positions Q1 and R1 via the positions Q5, Q6 and R5, R6 shown in FIG. 18, respectively, by virtue of the succeeding rotation of the cams 110, 119 and 129.

Subsequently, the bag body 1 is conveyed to the working position (IX) not shown in the drawings, where the front and rear edges of the cover plate and the corresponding portions of the bottom of the bag body are heat-sealed along the lengthwise direction like in the case of the working position (VI), whereby a square bag according to the present invention can be produced.

What is claimed is:

1. A machine for manufacturing a square bag consisting of a flat tubular body made of thermoplastic film with the outer surface thereof processed to be hardly weldable and having its top opening closed by the use of a cover plate with a valve plate, said machine comprising:

a pair of elongated surface plates installed face to face with a slit therebetween, said plates being equipped with plural upper clamp mechanisms for holding said tubular body between said plates at fixed intervals therealong;

a conveying apparatus movable along said surface plates for conveying said tubular body along said slit, said conveying apparatus including plural lower clamp mechanisms for holding said tubular body positioned between said surface plates, whereby when the tubular body is held by the lower clamp mechanisms it is conveyed along the slit between the surface plates by forward movement of the conveying apparatus, and wherein the corresponding upper clamp mechanisms hold said tubular body when the tubular body is released from the lower clamp mechanisms so that the conveying apparatus returns to its former position;

means for opening the top of the tubular body when said tubular body is being held by said upper clamp mechanisms;

a press device for pressing the open top of the tubular body against the surface plates and forming front and rear horizontal flaps and a pair of bisymmetric triangular end flaps lapping over two sides of said flaps on said top;

a first apparatus for installing the valve plate into the pressed top of the tubular body, said first apparatus inserting one side edge of the valve plate as held on a receiving plate beneath one triangular end flap, then releasing the valve plate from the receiving plate and pulling out the receiving plate from beneath the triangular end flap;

a second apparatus for installing the cover plate into the pressed top of the tubular body, said second apparatus inserting one side edge of the cover plate as held on a receiving plate beneath the other triangular end flap and at the same time overlapping the other side edge of said cover plate over the valve plate, then releasing the cover plate from the receiving plate and pulling out the receiving plate from beneath said other triangular end flap;

means for heat-sealing the overlapping portions when the valve plate and the cover plate have been inserted beneath the triangular end flaps by said first and second apparatuses; and means for heat-sealing the front and rear edges of the valve plate and the cover plate onto the front and rear edges of the horizontal flaps of the tubular body.

2. A machine for manufacturing a square bag consisting of a flat tubular body made of thermoplastic film with the outer surface thereof processed to be hardly weldable and having its openings closed by cover plates, said machine comprising:

a pair of elongated surface plates installed face to face with a slit therebetween, said plates being equipped with plural upper clamp mechanisms for holding said tubular body between said plates at fixed intervals therealong;

a conveying apparatus movable along said plates for conveying said tubular body along said slit, said conveying apparatus including plural lower clamp mechanisms for holding said tubular body positioned between said surface plates, whereby when the tubular body is held by the lower clamp mechanisms it is conveyed along the slit between the surface plates by forward movement of the conveying apparatus, and wherein the corresponding upper clamp mechanisms hold said tubular body when the tubular body is released from the lower clamp mechanisms so that the conveying apparatus returns to its former position;

means for opening the top of the tubular body when said tubular body is being held by said upper clamp mechanisms;

a press device for pressing the open top of the tubular body against the surface plates and forming front and rear horizontal flaps and a pair of bisymmetric triangular end flaps lapping over two sides of said flaps on said top;

an apparatus for installing the cover plate into the pressed top of the tubular body, said apparatus inserting two side edges of the cover plate as held on a receiving plate beneath the respective triangular end flaps, then releasing the cover plate from the receiving plate after the portion of the cover plate inserted beneath the triangular end flap has been heat-sealed and pulling out the receiving plate from beneath the triangular end flaps;

means for heat-sealing the overlapping portions when the cover plate has been inserted beneath the triangular end flaps; and means for heat-sealing the front and rear edges of the cover plate onto the front and rear edges of the horizontal flaps of the tubular body.

3. A machine for manufacturing a square bag having a flat tubular body made of plastic film and having its end openings closed by cover plates, said machine comprising:

elongated guide means defining an elongated guide slot through which the tubular body is guidably moved during formation of the bag, said guide means defining a plurality of working stations positioned sequentially therealong;

a plurality of first clamping mechanisms associated with said guide means at the individual stations therealong for permitting clamping of the tubular body at the individual working stations, said first clamping means including a pair of opposed clamping members for clampingly engaging the tubular body therebetween to maintain said tubular body in a supported position;

conveying means for sequentially moving said tubular body in an intermittent steplike manner between adjacent working stations, said conveying means including a carriage movably supported adjacent said guide means and a drive mechanism connected to said carriage for moving said carriage in a reciprocating manner along a line of movement which is substantially parallel with the longitudinal direction of said slot, said drive mechanism causing said carriage to reciprocate back and forth through a distance substantially equal to the spacing between adjacent working stations;

a plurality of second clamping mechanisms mounted on said carriage at spaced intervals therealong for engaging the tubular body and moving same between adjacent working stations, said second clamping mechanism including opposed clamping members which engage the tubular body therebetween for advancing the tubular body from one working station into the next adjacent working station during forward movement of the carriage, said second clamping mechanisms being released from the tubular body during return movement of the carriage whereupon the tubular body is maintained in the next adjacent working station by one of said first clamping mechanisms;

separation means for separating the sidewalls of the tubular body adjacent one of said end openings for opening said one end opening, said end opening being disposed adjacent a first working station and said separation means acting on said tubular body when same is clampingly held in said first working station by one of said first clamping mechanisms;

pressing means for pressing the previously opened end of the tubular body against said guide means for forming a pair of side flaps which are spread outwardly in opposite directions and extend substantially transversely from opposite sides of the tubular body and for also simultaneously forming a pair of bisymmetric triangular end flaps which each overlap the two side flaps, said pressing means being located at a second working station which is disposed adjacent said first working station but displaced downstream therefrom, said tubular body being clampingly held in said second working station by one of said first clamping mechanisms when said pressing means acts thereon;

an apparatus for inserting the cover plate into the pressed end of the tubular body so that one end of the cover plate is inserted between the triangular end flap and the adjacent overlapped portions of the side flaps, said apparatus being positioned at a third working station which is disposed adjacent said second station but is displaced downstream thereof, said tubular body being maintained in said third working station by one of said first clamping mechanisms when said apparatus acts thereon; and means for heat-sealing the cover plate to the tubular body.

4. A machine according to claim 3, wherein the first clamping mechanisms maintain the tubular body in a vertically suspended position when held in said first, second and third working stations, the separating means and the pressing means acting on the top end of said tubular body for permitting the cover plate to be attached thereto;

inverting means located at a fourth working station disposed downstream of said heat sealing means for engaging said tubular body and rotating same within a vertical plane through an angle of substantially 180° so that the other open end of the tubular body is located at the top of said tubular body;

second conveying means for transferring the thus inverted tubular body from said inverting means downstream into further spaced working stations, said second conveying means including a second reciprocating carriage which is movable back and forth between adjacent working stations; and a mechanism located at a further working station disposed downstream of said inverting mechanism for attaching a further cover plate to the other open end of said bag, which other open end is now located at the upper end of said tubular body.

5. A machine according to claim 4 wherein said inverting means comprises:

a frame supported for rotation about a substantially horizontal axis, said frame having first and second arm means projecting outwardly in opposite directions from and substantially perpendicular to said axis;

each said arm means being of a bifurcated construction and including first and second horizontally spaced arm portions having an elongated slot therebetween which opens outwardly of said arm means through the free end thereof;

third and fourth clamping mechanisms respectively mounted on said first and second arm means, each of said third and fourth clamping mechanisms including first and second clamping portions respectively associated with the first and second arm portions for permitting the tubular bag body to be clampingly held between the clamping portions when the bag body is inserted into one of the elongated slots;

means associated with said third and fourth clamping mechanisms for permitting selective activation or deactivation thereof; and drive means connected to said frame for causing angular roation thereof about said horizontal axis from a first position wherein said bag body is inserted into one of said slots to a second position wherein said bag body is removed from said one slot.

6. A machine according to claim 5, wherein said first and second arm means each include first and second arms which are substantially parallel and are vertically spaced apart so that said frame has a substantially H-shaped configuration, each of said first and second arms being defined by said horizontally spaced first and second arm portions having an elogated slot disposed therebetween, and said third and fourth clamping mechanisms each including a pair of clamping devices one of which is associated with each of said first and second arms so that the tubular bag body is grippingly engaged adjacent the opposite ends thereof.

* * * * *